US006290541B1

(12) United States Patent
Furusho et al.

(10) Patent No.: US 6,290,541 B1
(45) Date of Patent: Sep. 18, 2001

(54) CONNECTOR FOR IC CARD, HAVING SHIELDING PLATES

(75) Inventors: Hidetaka Furusho; Kazuki Satou; Wataru Oguchi, all of Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 09/638,168

(22) Filed: Aug. 11, 2000

(30) Foreign Application Priority Data

Sep. 9, 1999 (JP) ..... 11-255256

(51) Int. Cl.[7] ..... H01R 13/648
(52) U.S. Cl. ..... 439/607
(58) Field of Search ..... 439/607, 108, 439/64

(56) References Cited

U.S. PATENT DOCUMENTS 5,795,190 8/1998 Ono ..... 439/607
6,077,119 * 6/1998 Yu et al. ..... 439/607
6,095,864 * 6/1999 Yu et al. ..... 439/607
6,146,193 * 6/1999 Yu ..... 439/607
6,152,773 * 6/1999 Chen ..... 439/607

* cited by examiner

*Primary Examiner*—Brian Sircus
*Assistant Examiner*—Javaid Nasri
(74) *Attorney, Agent, or Firm*—Beyer Weaver & Thomas, LLP

(57) ABSTRACT

A connector for IC cards comprising a housing with a plurality of connecting terminals attached thereto, shielding plates disposed on a peripheral surface of the housing, and a circuit board to which the housing and the shielding plates are mounted, wherein the shielding plates are disposed respectively on both an upper surface side and a lower surface side of the housing. Each of the shielding plates are formed with grounding portions and are mounted to the circuit such that the grounding portions are in a superposed arrangement.

6 Claims, 7 Drawing Sheets

CONNECTOR FOR IC CARD, HAVING SHIELDING PLATES

BACKGROUND OF THE INVENTION

1. Field of the Invention

The present invention relates to a structure of a connector for IC cards to be used as a storage medium in a personal computer or the like. Particularly, the invention is concerned with a grounding structure of shielding plates.

2. Description of the Prior Art

As an expanded memory for personal computers, there generally is employed a connector for IC cards. As a storage medium for such IC card connectors, IC cards have come to be used widely. On the IC card is mounted an IC (integrated circuit) for the storage of various information pieces, and for preventing a malfunction of the IC, a protuberance (a grounding piece) for grounding is provided on a peripheral surface of the IC card. The protuberance functions to prevent the influence of a bounce noise generated within the circuit or an external noise entering from the exterior.

It is known that also on the IC card connector side for the loading of such an IC card having a protuberance there is mounted a shielding plate for preventing the influence of such bounce noise or external noise as referred to above.

For example, according to a known structure of a shielding plate used in an IC card connector, an electrically conductive metallic plate utilized as a shielding plate is disposed on either an upper surface side or a lower surface side of a connector housing. This shielding plate is disposed so as to cover upper surfaces of plural contact terminals fixed to the connector housing and is centrally formed with plural contact pieces capable of contacting a protuberance of an IC card.

Further, at both ends of the shielding plate are formed grounding portions capable of contacting a grounding pattern formed on a circuit board onto which the connector housing is mounted and fixed. By fixing the grounding portions to the circuit board with screws, the shielding plate is grounded to the grounding pattern and the housing is fixed to the circuit board.

However, in the above conventional shielding plate structure for an IC card connector, the shielding plate is disposed on only one of the upper and lower surface sides of the connector housing, covering only one side of the plural contact terminals fixed to the housing, and thus it is difficult to diminish the influence of a bounce noise or an external noise, both of which are capable of causing a malfunction of the IC on the IC card.

Besides, since the shielding plate is disposed on a peripheral surface of the connector housing, it is difficult to reduce the thickness of the whole of the connector.

SUMMARY OF THE INVENTION

Accordingly, it is an object of the present invention to solve the above-mentioned problems and provide a structure of an IC card connector having shielding plates, capable of covering both sides of contact terminals fixed to a housing, capable of diminishing a bounce noise and an external noise, having a simple structure, and capable of being reduced in thickness.

For achieving the above-mentioned object, in one aspect of the present invention there is provided a connector for an IC card, comprising a housing with plural connecting terminals attached thereto, shielding plates disposed on a peripheral surface of the housing, and a circuit board to which the housing and the shielding plates are mounted, wherein the shielding plates are disposed respectively on both upper surface side and lower surface side of the housing, are formed with grounding portions respectively and are mounted to the circuit board in a superposed state of the grounding portions.

In another aspect of the present invention, the housing is formed with an accommodating recess for accommodating therein the shielding plates so as to be substantially flush with the upper surface and/or the lower surface of the housing.

In a further aspect of the present invention, the shielding plates are each formed with plural contact pieces capable of contacting the IC card.

In a still further aspect of the present invention, the shielding plates comprise a first shielding plate positioned on the lower surface side and a second shielding plate positioned on the upper surface side.

In a still further aspect of the present invention, the grounding portion of the second shielding plate is formed with a protuberance, while the grounding portion of the first shielding plate is formed with a relief portion for avoiding superposition thereof on the protuberance and so that the protuberance of the second shielding plate and a lower surface of the grounding portion of the first shielding plate become flush with an upper surface of the circuit board when the grounding portions of the first and second shielding plates are superposed together.

In a still further aspect of the present invention, the protuberance of the second shielding plate is formed so that the height thereof is substantially equal to the thickness of the grounding portion of the first shielding plate.

DETAILED DESCRIPTION OF A PREFERRED EMBODIMENT

Figure 1:
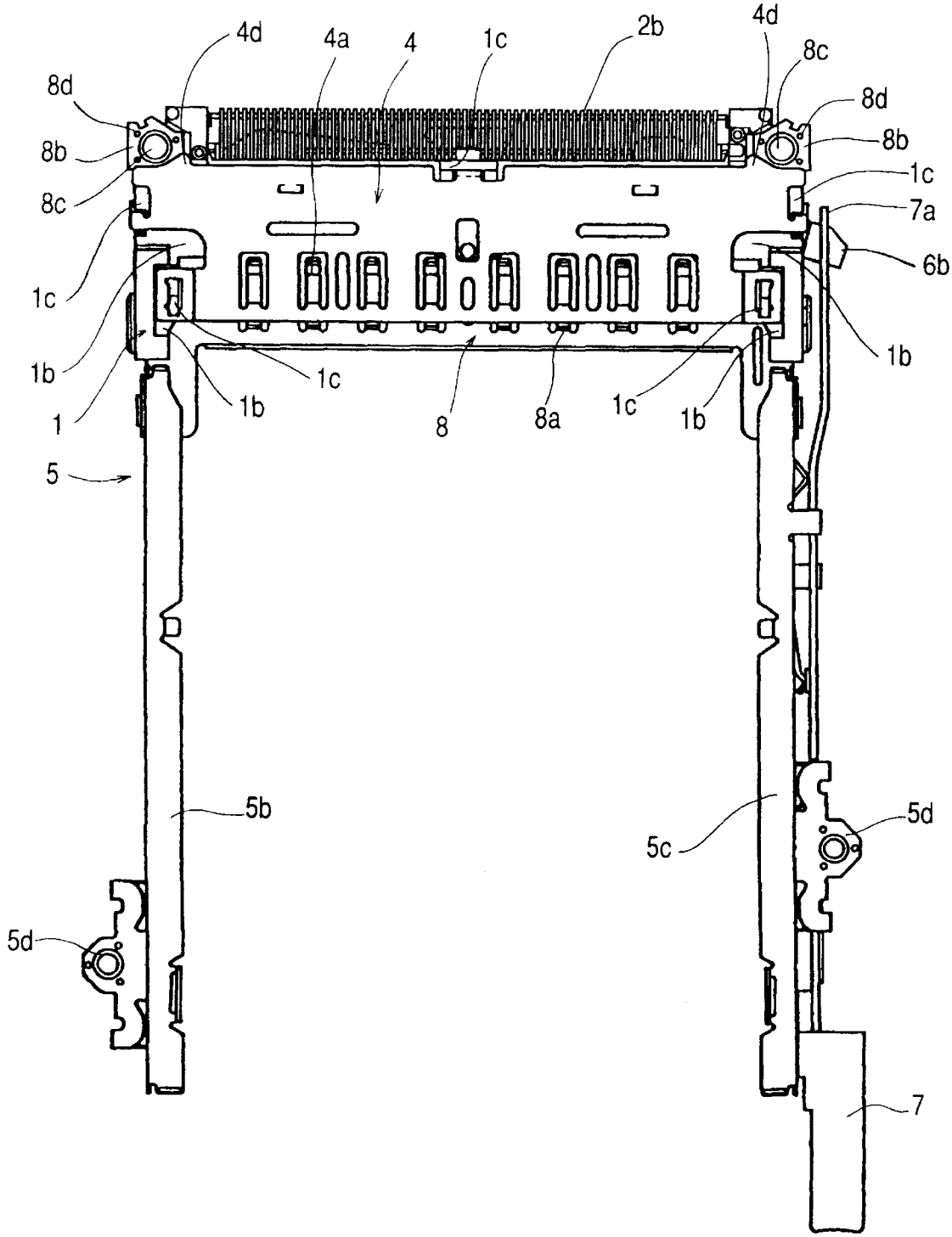
FIG. 1 is a bottom view of a connector for IC card according to an embodiment of the present invention.
Figure 2:
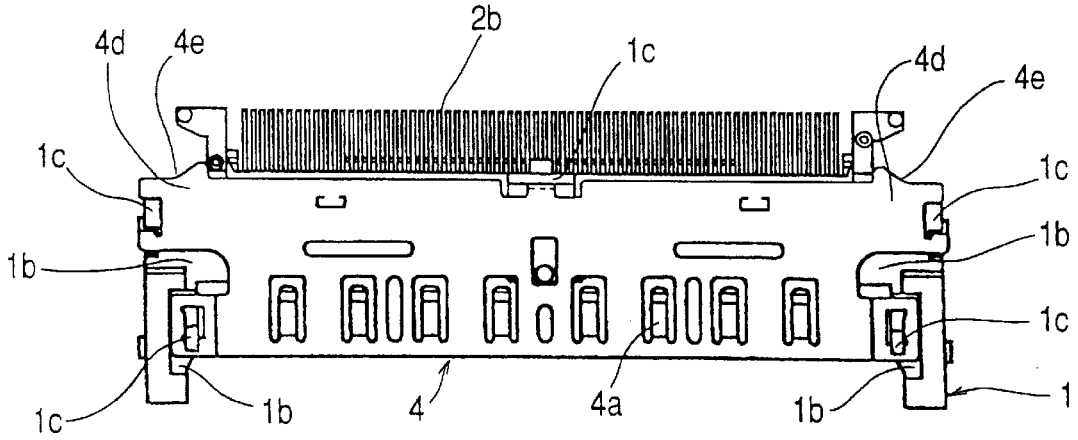
FIG. 2 is a bottom view showing a fixed state of a housing and a first shielding plate.
Figure 3:
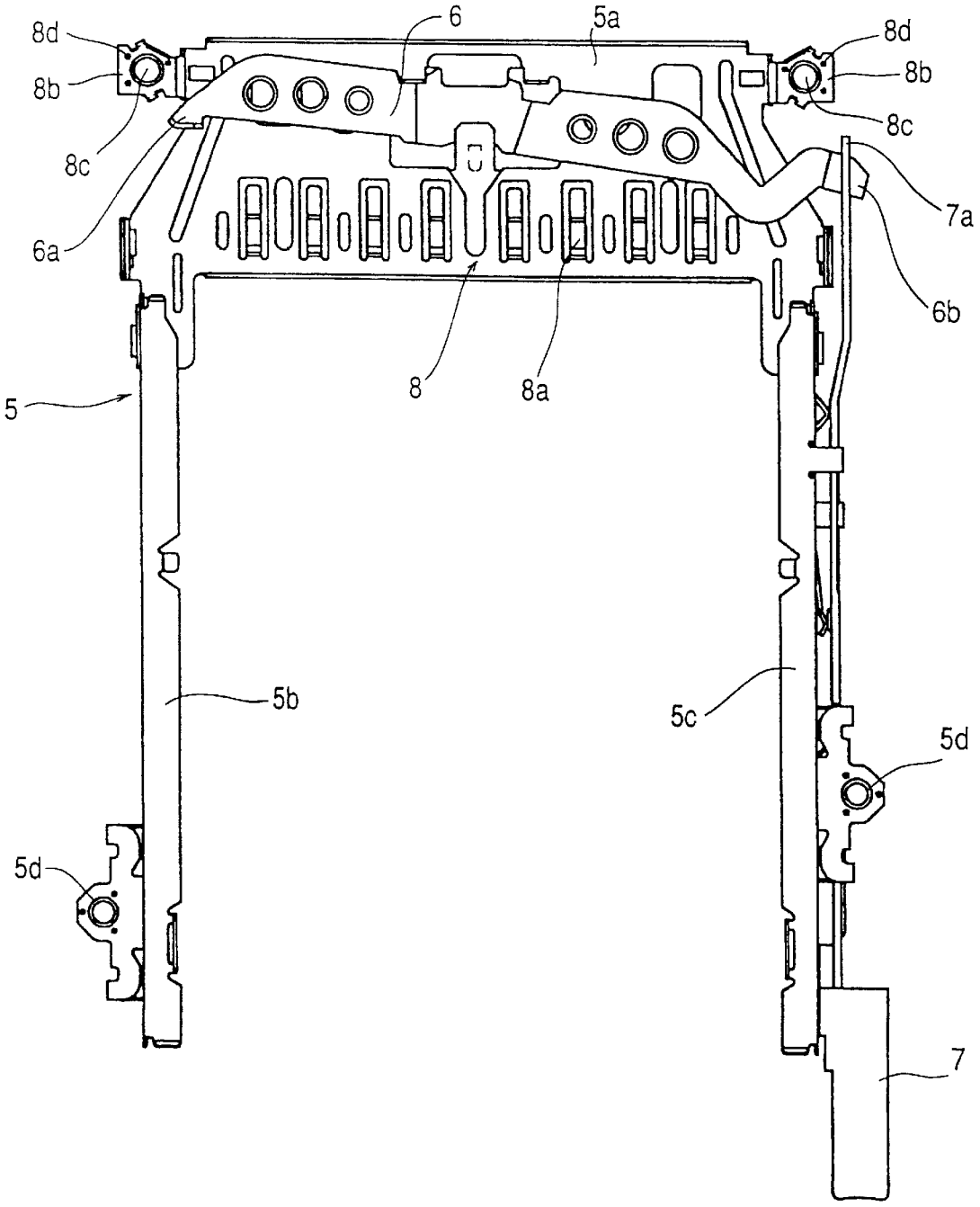
FIG. 3 is a bottom view showing a frame and a second shielding plate.
Figure 4:
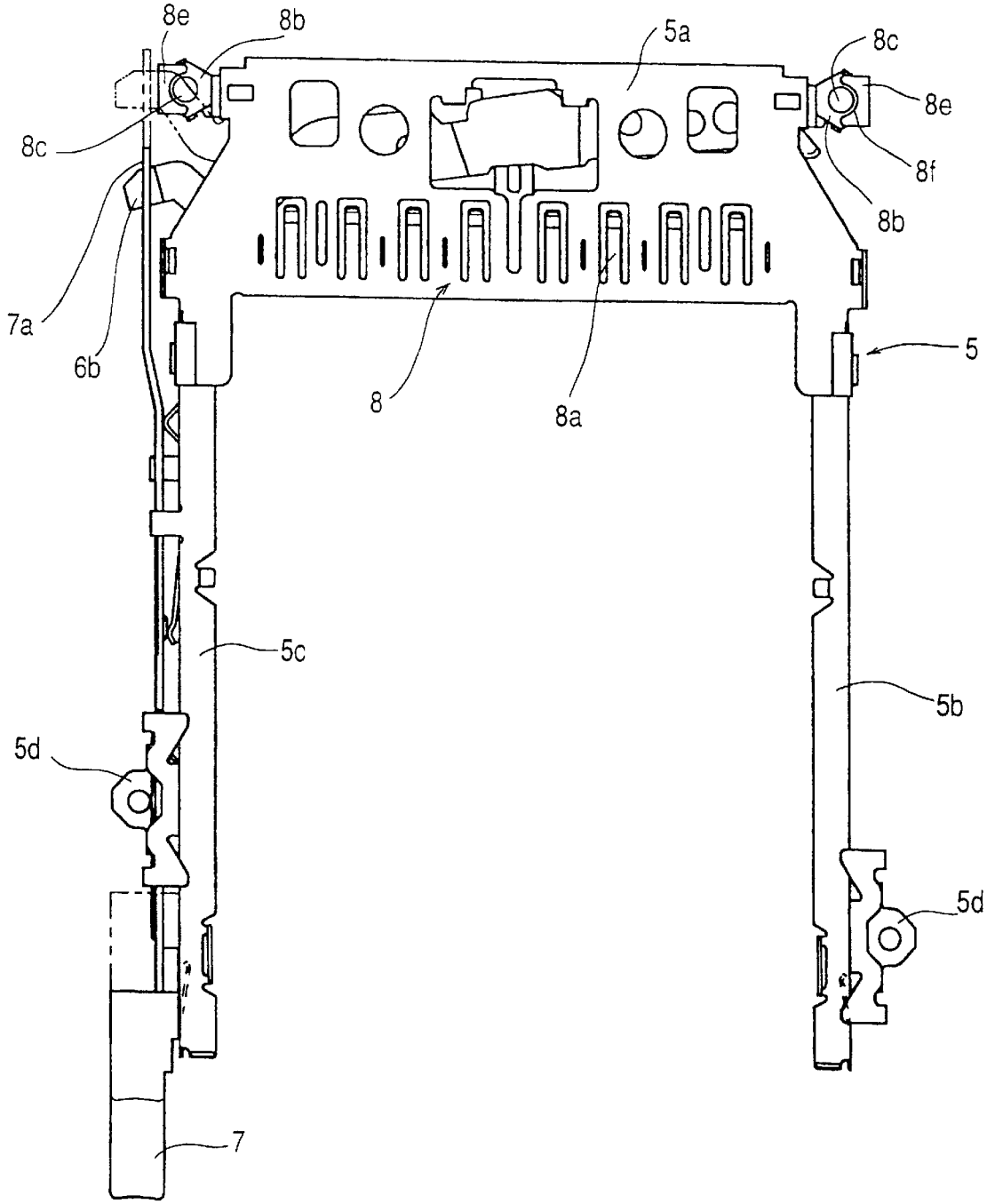
FIG. 4 is a top view of the frame and the second shielding plate of FIG. 3.
Figure 5:
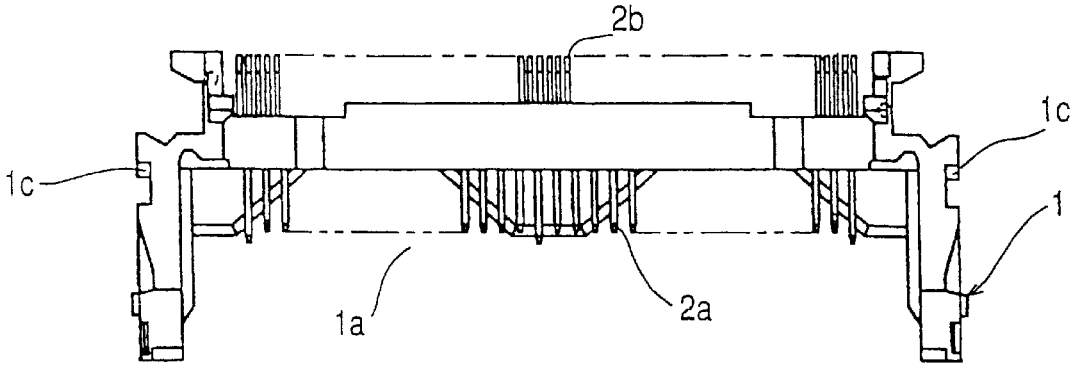
FIG. 5 is a top view of the housing.
Figure 6:
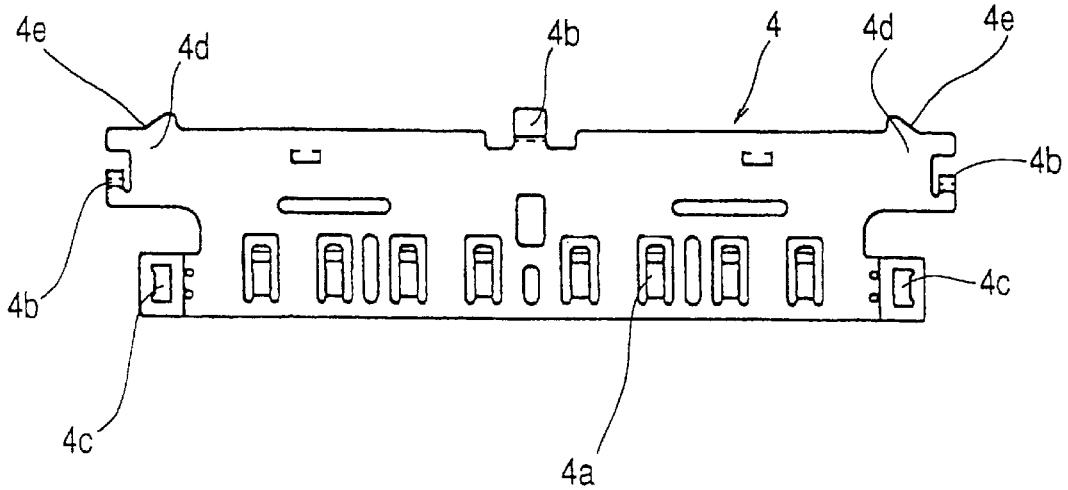
FIG. 6 is a top view of the first shielding plate.
Figure 7:
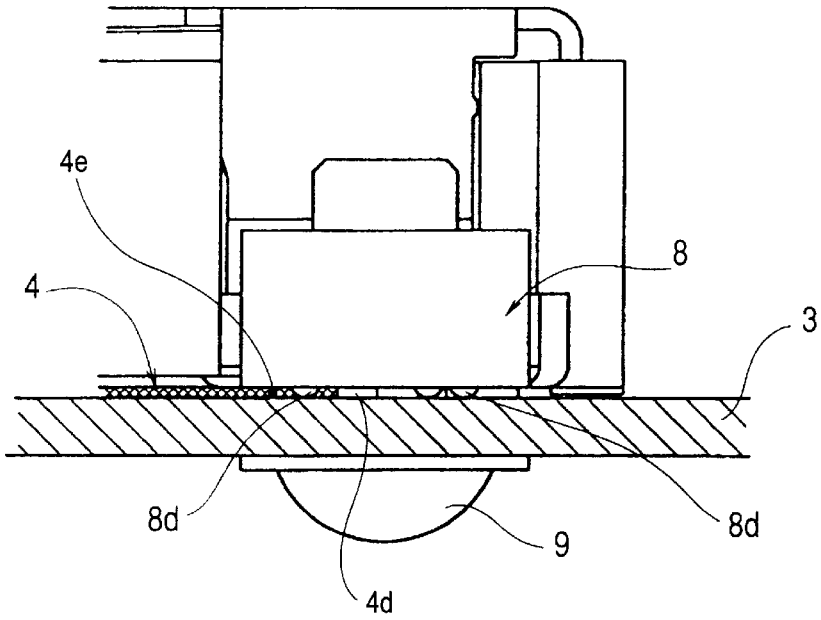
FIG. 7 is an explanatory diagram showing a grounded state of grounding portions of the first and second shielding plates.
Figure 8:
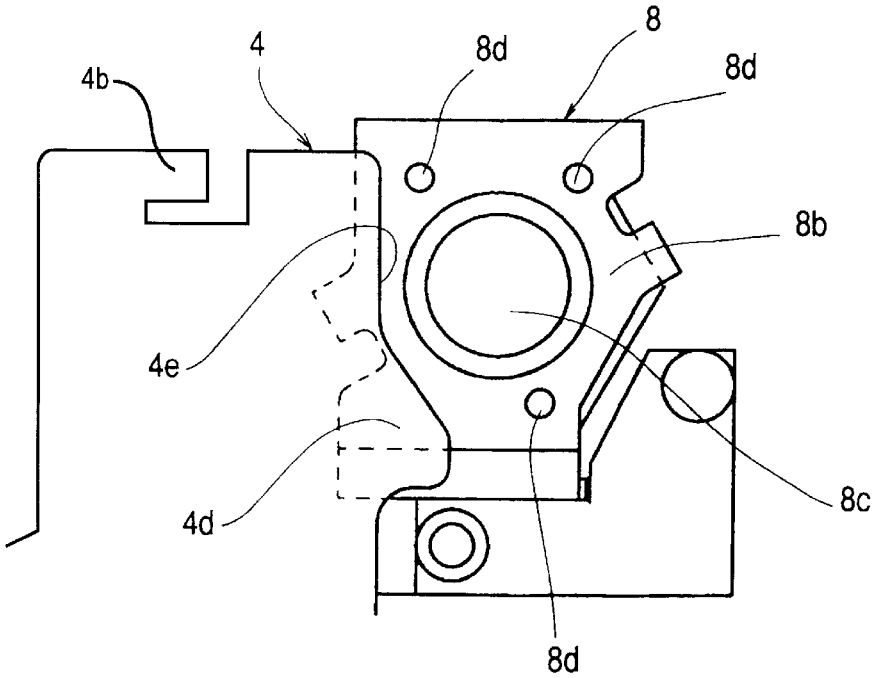
FIG. 8 is an explanatory diagram showing a superposed state of the grounding portions of the first and second shielding plates.
Figure 9:
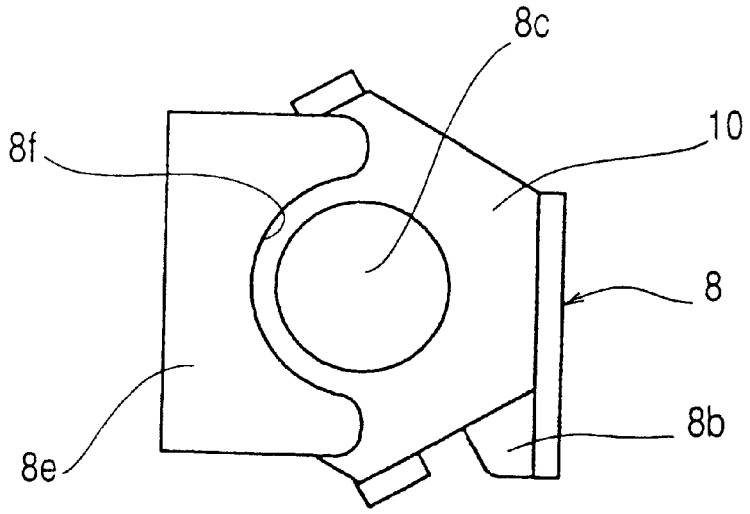
FIG. 9 is a plan view showing a swivel-stop portion for a nut.
Figure 10:
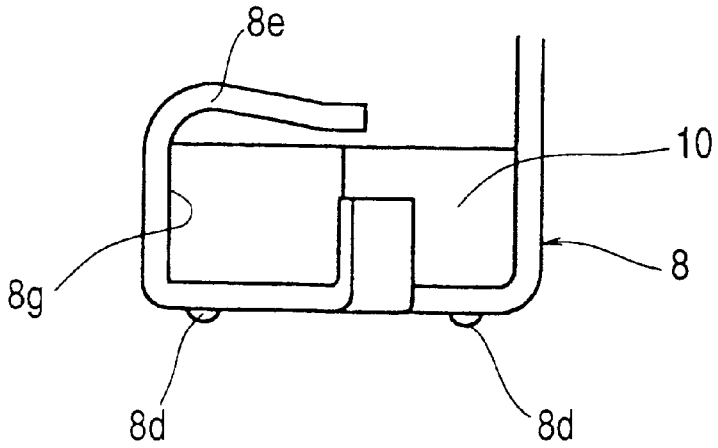
FIG. 10 is a side view of the swivel-stop portion for the nut of FIG. 9.

An embodiment of the present invention is illustrated in FIGS. 1 to 10, of which FIG. 1 is a bottom view of a connector of an IC card embodying the present invention, FIG. 2 is a bottom view showing a fixed state of a housing and a first shielding plate, FIG. 3 is a bottom view of a frame and a second shielding plate, FIG. 4 is a top view thereof, FIG. 5 is a top view of the housing, FIG. 6 is a top view of the first shielding plate, FIG. 7 is an explanatory diagram showing a grounded state of grounding portions of the first and second shielding plates, FIG. 8 is an explanatory diagram showing a superposed state of the grounding portions of the first and second shielding plates, FIG. 9 is a plan view of a swivel-stop portion for a nut, and FIG. 10 is a side view thereof.

In the figures, a housing 1 is formed of an insulating material such as a synthetic resin, with a loading portion 1*a* for insertion therein of an IC card being formed in the housing 1. On an inner bottom of the loading portion 1*a* are arranged a plurality of contact terminals 2*a* formed of an electrically conductive metallic material. Opposite end sides of the contact terminals 2*a* are drawn out to the exterior of the housing 1 and connecting terminals 2*b* are formed for connection with circuit patterns (not shown) formed on a circuit board on which the connector is mounted.

On both upper and lower surface sides of the housing 1 are formed accommodating recesses 1*b* for accommodating therein shielding plates which will be described later. The accommodating recesses 1*b* are each formed at a depth substantially equal to the thickness of each shielding plate so as to be substantially flush with the upper and lower surfaces of the housing 1 when the shielding plates are mounted into the accommodating recesses 1*b*.

The housing 1 is provided with plural engaging portions 1*c* for engagement with the shielding plates.

The shielding plates comprise first and second shielding plates. The first shielding plate, indicated at 4, is formed by an electrically conductive metallic plate such as a phosphor bronze plate. The first shielding plate 4 is cut and raised centrally to form a plurality of contact pieces 4*a* for contact with a protuberance (a grounding pieces) of an IC card (not shown). Centrally at one side of the first shielding plate 4 and at both end portions thereof there are formed engaging pieces 4*b* and engaging holes 4*c* to be engaged with and positioned by the housing 1.

Further, at both end portions of the first shielding plate 4 are formed grounding portions 4*d* to be overlapped with the second shielding plate which will be described later. In the grounding portions 4*e* are formed relief portions 4*d* as cutout portions respectively. The relief portions 4*e* are for avoiding overlapping with protuberances formed on the second shielding plate when the grounding portions 4*d* are superposed on the second shielding plate.

A frame 5 is formed in a general U shape using an electrically conductive metallic plate such as a phosphor bronze plate. Centrally of the frame 5 is provided a flat plate-like base portion 5*a* which is integral with the second shielding plate to be described later. At both ends of the base portion 5*a* are formed a pair of guide portions 5*b* and 5*c* along which an IC card is inserted and removed and which are extended substantially in parallel with each other.

An ejection lever 6 is secured to the base portion 5*a* of the frame 5. The ejection lever 6 is held pivotably at a central part thereof. At one free end of the ejection lever 6 is formed an arm portion 6*a* for abutment against an IC card to eject the card, while at an opposite free end of the ejection lever 6 is formed a drive end portion 6*b* which projects from a side face of the base portion 5*a*.

An ejection knob 7 for ejecting an IC card is attached slidably to one guide portion 5*c* of the paired guide portions 5*b* and 5*c*. At a tip end of the ejection knob 7 is formed an operating end 7*a* for engagement with the drive end portion 6*b* of the ejection lever 6. By engagement of the operating end 7*a* with the drive end portion 6*b* and with a pushing motion of the ejection knob 7, the arm portion 6*a* formed at a free end of the ejection lever 6 moves pivotally to eject the IC card loaded between the guide portions 5*b* and 5*c*.

The guide portions 5*b* and 5*c* are respectively formed with mounting portions 5*d* for mounting the frame 5 with screws when the frame is put for fixing onto the circuit board 3.

The second shielding plate, indicated at 8, is integral with the base portion 5*a* of the frame 5 which is formed by an electrically conductive metallic plate such as a phosphor bronze plate. The second shielding plate 8 is formed in a position opposed to the first shielding plate 4 which is engaged with the housing 1. Like the first shielding plate 4, the second shielding plate 8 is cut and raised centrally to form a plurality of contact pieces 8*a* for contact with a protuberance (a grounding piece) of an IC card (not shown).

At both end portions of the second shielding plate 8 are formed grounding portions 8*b* to be overlapped with the first shielding plate 4, the grounding portions 8*b* extending outward and being formed in plural steps. The grounding portions 8*b* are centrally formed with screw inserting holes 8*c* respectively for insertion therein of screws to fix the frame 5 onto the circuit board 3. The fixing operation is performed in cooperation with the mounting portions 5*d* of the guide portions 5*b* and 5*c*.

In this embodiment, the second shielding plate 8 is mounted on an upper surface side of the housing 1 and the first shielding plate 4 is mounted on a lower surface side of the housing (the circuit board 3 side).

On the grounding portion 8*b* are formed a plurality of protuberances 8*d* projecting to the circuit board 3 side in such a manner that the height of each protuberance 8*d* is almost equal to the thickness of each grounding portion 4*d* of the first shielding plate 4. By so restricting the projecting size of the protuberances 8*d*, when the grounding portions 4*d* of the first shielding plate 4 and the grounding portions 8*b* of the second shielding plate 8 are superposed one on the other, the protuberances 8*d* of the second shielding plate 8 and lower surfaces of the grounding portions 4*d* of the first shielding plate 4 become flush with an upper surface of the circuit board 3, thus permitting both grounding portions to be grounded simultaneously.

In this case, since the grounding portions 4*d* of the first shielding plate 4 are respectively formed with relief portions 4*e* to avoid overlapping with the protuberances 8*d*, the grounding portions 4*d* and 8*b* can be grounded simultaneously in a superposed state of the first and second shielding plates 4, 8.

According to the above construction, since the plural contact terminals 2*a* formed on the housing 1 are covered with the first and second shielding plates 4, 8 from both upper and lower surface sides of the housing 1, it is possible to minimize the influence of a bounce noise in the circuit and an external noise. Besides, since the grounding portions 4*d* and 8*b* can be superposed and fixed together with bolts, a simple structure can be realized.

Moreover, the accommodating recesses 1*b* for accommodating therein the first and second shielding plates 4, 8 are formed in the upper and lower surfaces of the housing 1 at about the same depth as the thickness of each shielding plate so as to be substantially flush with the upper and lower surfaces of the housing when the shielding plates 4 and 8 are received in the recesses 1*b*. Thus, the reduction of thickness can be attained without increase in external form of the housing 1.

In this embodiment, if the first shielding plate 4 positioned on the circuit board 3 side is not mounted with the intention of reducing the number of components used for example, only the grounding portions 8*b* of the second shielding plate 8 are grounded to the circuit board 3. In this case, since the protuberances 8*d* are formed, a gap corresponding to the thickness of the first shielding plate 4 is prevented from being formed between the second shielding plate and the circuit board 3. Such a gap would cause a poor contact.

Thus, components can be used in common to both the product wherein the first and second shielding plates 4, 8 are mounted on both lower and upper surfaces of the housing 1 and the product wherein the first shielding plate 4 on the lower surface side is not used.

Each grounding portion 8*b* is formed with a bent portion 8*e* formed by extending an end of the grounding portion 8*b* and bending it in a general U shape. In a tip end of the bent portion 8*e* is formed a generally U-shaped cutout 8*f*. The cutout 8*f* is formed by allowing an end of the grounding portion 8*b* to extend along an outer periphery of a mounting screw 9 and allowing a tip end thereof to cross the screw. The bent portion 8*e* serves as a swivel-stop portion for a nut 10 which is fitted on the mounting screw 9.

Since the cutout 8*f* is formed in the bent portion 8*e,* even when the bent portion 8*e* is bent to an upper side of the nut 10 to sandwich the nut between the tip end of the bent portion 8*e* and the grounding portion 8*b,* it is possible to avoid abutment against the portion of the screw 9 which portion projects from the nut 10. Besides, machining is easy because the tip end of the bent portion 8*e* can be formed in a long extended state.

Since the bent portion 8*e* is formed in the grounding portion 8*b,* the mounting nut 10 is retained between the grounding portion 8*b* and the bent portion 8*e*. Further, since the tip end of the bent portion 8*e* is bent to the upper side of the nut 10 and a side wall 8*g* of the bent portion 8*e* is brought into engagement with an outer side face of the nut 10 to serve as a swivel stop for the nut, it is possible to realize a simple construction, easy machining, and reliable swivel prevention.

According to the above construction, since the swivel-stop portion for the mounting nut 10 is formed integrally with the grounding portion 8*b,* the construction is simplified; besides, since it is formed by bending a tip end of the grounding portion, it is easy to effect machining and the swivel-stop portion can be positively brought into engagement with the nut 10 without the need of enhancing the machining accuracy and assembling accuracy, thus ensuring swivel stop.

In the IC card connector according to the present invention, as set forth above, shielding plates are disposed respectively on both upper and lower surface sides of the housing, are formed with grounding portions respectively and are mounted to a circuit board in a superimposed state of the grounding portions. Therefore, it is possible to minimize the influence of a bounce noise in the circuit and an external noise. Besides, since the grounding portions can be fixed with a bolt in a superimposed state, a simple structure can be realized.

Moreover, since the housing is formed with an accommodating recess for accommodating therein the shielding plates so as to be substantially flush with the upper surface and/or the lower surface of the housing, it is possible to attain the reduction of thickness without increase in the size of an external form of the housing.

Further, since the shielding plates are each formed with plural contact pieces capable of contacting an IC card, it becomes easy for the contact pieces to contact a protuberance of the IC card, whereby a bounce noise and an external noise can be diminished.

Further, since the shielding plates comprise a first shielding place positioned on the lower surface side and a second shielding plate positioned on the upper surface side, it is possible to use components in common to both a product wherein the first and second shielding plates are mounted on both lower and upper surface sides of the housing and a product wherein the first shielding plate on the lower surface side is not used.

Further, since the grounding portion of the second shielding plate is formed with protuberances, while the grounding portion of the first shielding plate is formed with a relief portion for avoiding superposition thereof on the protuberances and so that protuberances of the second shielding plate and a lower surface of the grounding portion of the first shielding plate become flush with an upper surface of the circuit board when the grounding portions of the first and second shielding plates are superposed together. Consequently, the grounding portions of the first and second shielding plates 4, 8 can be grounded simultaneously in a superposed state of both shielding plates.

Further, since the protuberances of the second shielding plate are formed so that the height thereof is substantially equal to the thickness of the grounding portion of the first shielding plate, a gap corresponding to the thickness of the first shielding plate is prevented from being formed between the second shielding plate and the circuit board. Such a gap would cause a poor contact.

What is claimed is:

1. A connector for an IC card, comprising:

a housing with a plurality of connecting terminals attached to the IC card;

a first shielding plate and a second shielding plate disposed to cover an upper surface and a lower surface of the housing, each of the first and second shielding plates having grounding portions; and a circuit board to which the housing and the first and second shielding plates are mounted;

wherein the first and second shielding plates are mounted to the circuit board such that the grounding portions are in a superposed arrangement, also wherein the first and second shielding plates are each formed with a plurality of contact pieces capable of contacting the IC card.

2. The connector for an IC card according to claim 1, wherein the housing is formed with accommodating recesses for accommodating therein the first and second shielding plates so as to be substantially flush with the upper surface and/or the lower surface of the housing.

3. The connector for an IC card according to claim 1, wherein the grounding portions of the first and second shielding plates are connected to the ground of the circuit board so that the first and second shielding plates are electrically grounded.

4. The connector for an IC card according to claim 1, wherein the plurality of contact pieces are in contact with the outer surface of the circuit board.

5. The connector for an IC card comprising:

a housing with a plurality of connecting terminals attached to the IC card;

a first shielding plate and a second shielding plate disposed to cover a lower surface and an upper surface, respectively, of the housing, each of the first and second shielding plates having grounding portions; and a circuit board to which the housing and the first and second shielding plates are mounted;

wherein the first and second shielding plates are mounted to the circuit board such that the grounding portions are in a superposed arrangement, also wherein the grounding portion of the second shielding plate is formed with a protuberance, while the grounding portion of the first shielding plate is formed with a relief portion, the relief portion serving to avoid interfering contact between the first shielding plate and the protuberance of the second shielding plate when the first and second shielding plates are placed in a superposed arrangement, also wherein the protuberance of the second shielding plate and a lower surface of the grounding portion of the first shielding plate become flush and come into contact with an upper surface of the circuit board when the grounding portions of the first and second shielding plates are placed in a superposed arrangement.

6. The connector for an IC card according to claim 5, wherein the protuberance of the second shielding plate is formed so that the height thereof is substantially equal to the thickness of the grounding portion of the first shielding plate.

* * * * *